US012349804B2

(12) United States Patent
Huang et al.

(10) Patent No.: US 12,349,804 B2
(45) Date of Patent: Jul. 8, 2025

(54) SIDE-EMBOSSED INFLATABLE PRODUCT

(71) Applicant: BESTWAY INFLATABLES & MATERIAL CORP., Shanghai (CN)

(72) Inventors: Shuiyong Huang, Shanghai (CN); Yihua You, Shanghai (CN); Qingshui Song, Shanghai (CN); Bingrong Wu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 382 days.

(21) Appl. No.: 17/829,727

(22) Filed: Jun. 1, 2022

(65) Prior Publication Data

US 2023/0132601 A1 May 4, 2023

(30) Foreign Application Priority Data

Oct. 29, 2021 (CN) ..... 202122622919.2

(51) Int. Cl.
*A47C 27/10* (2006.01)
*A47C 4/54* (2006.01)
(Continued)

(52) U.S. Cl.
CPC ..... *A47C 27/10* (2013.01); *A47C 4/54* (2013.01); *A47C 17/86* (2013.01); *A47C 27/081* (2013.01)

(58) Field of Classification Search
CPC .... A47C 27/081; A47C 27/087; A47C 27/088
See application file for complete search history.

(56) References Cited

U.S. PATENT DOCUMENTS 4,037,591 A * 7/1977 Sarno ..... A61H 7/001 5/699
5,329,656 A * 7/1994 Leggett ..... A47C 27/18 5/709
(Continued)

FOREIGN PATENT DOCUMENTS

CN 2605784 Y * 3/2004
CN 1736293 B * 6/2011 ..... A47C 17/32
(Continued)

OTHER PUBLICATIONS

Extended European Search Report dated Dec. 12, 2022 (Dec. 12, 2022) issued on related European patent application 22179988.5 by the European Patent Office.

*Primary Examiner* — Eric J Kurilla
(74) *Attorney, Agent, or Firm* — DICKINSON WRIGHT PLLC

(57) ABSTRACT

An inflatable product is provided including a top sheet, a bottom sheet, a lateral confining sheet, and an internal connecting sheet. A peripheral edge of the top sheet is connected to an upper edge of the lateral confining sheet, and a peripheral edge of the bottom sheet is connected to a lower edge of the lateral confining sheet, forming an inflatable chamber. An upper edge of the internal connecting sheet is connected to the top sheet, a lower edge of the internal connecting sheet is connected to the bottom sheet, and a connecting part of the internal connecting sheet, located between the upper edge and the lower edge of the internal connecting sheet, is connected to the lateral confining sheet along at least one welding seam. The at least one welding seam may form at least one embossment on an outside of the inflatable product.

8 Claims, 5 Drawing Sheets

(51) Int. Cl.
*A47C 17/86* (2006.01)
*A47C 27/08* (2006.01)

(56) References Cited

U.S. PATENT DOCUMENTS 7,089,618 B1* 8/2006 Metzger ..... A47C 27/087 5/709
9,254,047 B1 2/2016 Schermel et al.
10,945,533 B1* 3/2021 Shi ..... A47C 27/081
11,969,098 B1* 4/2024 Shi ..... A47C 27/087
2006/0265810 A1* 11/2006 Wu ..... A47C 27/081 5/712
2007/0283499 A1* 12/2007 Lin ..... A47C 27/081 5/713
2008/0105366 A1* 5/2008 Wang ..... B29C 66/114 156/219
2012/0079662 A1* 4/2012 Dzioba ..... A47C 27/10 5/713
2015/0201760 A1* 7/2015 Lin ..... A47C 27/087 5/710
2015/0335164 A1* 11/2015 Liu ..... F24F 1/022 156/278
2017/0196368 A1* 7/2017 Liu ..... A47C 27/16
2020/0100598 A1* 4/2020 Huang ..... A47C 27/087
2021/0127849 A1* 5/2021 Li ..... A47C 27/12
2021/0259434 A1* 8/2021 Wang ..... A47C 27/10
2022/0346564 A1* 11/2022 Huang ..... A47C 27/081

FOREIGN PATENT DOCUMENTS

CN 209202537 U * 8/2019
CN 209360158 U * 9/2019 ..... A47C 27/081
CN 111000399 A * 4/2020 ..... A47C 27/081
CN 111265060 A * 6/2020
CN 210727297 U * 6/2020
DE 202007008326 10/2007

* cited by examiner

SIDE-EMBOSSED INFLATABLE PRODUCT

CROSS-REFERENCE TO RELATED APPLICATION

This Application claims priority from Chinese Application CN 202122622919.2, filed Oct. 29, 2021 in China, the disclosure of which is incorporated herein by reference in its entirety.

BACKGROUND

1. Field

Apparatuses and methods consistent with example embodiments relate to a side-embossed inflatable product.

2. Description of the Related Art

An inflatable product, such as an inflatable bed and an inflatable sofa, has overcome the defect of bulkiness of traditional furniture, may be freely placed indoors and outdoors, and is popular to consumers due to its firmness in support, softness in bearing and convenience in storage.

Generally, the surface, which is in contact with a human body, of the inflatable product such as the inflatable bed and the inflatable sofa may be embossed to form patterns, such that the surface of the inflatable product is more aesthetic and comfortable. The side surfaces of some inflatable products may also be embossed. In an existing design, a side-embossed inflatable bed, as shown in FIG. 1, is provided with an outer confining sheet 4, and an inflatable chamber of the inflatable bed is internally provided with a first inner confining sheet 5 and a second inner confining sheet 6, where the second inner confining sheet 6 is located between the first inner confining sheet 5 and the outer confining sheet 4; and a middle portion of the second inner confining sheet 6 is connected to a middle portion of the first inner confining sheet 5, and an upper portion and a lower portion of the second inner confining sheet 6 are respectively connected to the outer confining sheet 4 and are embossed. According to the process of side embossment, the first inner confining sheet 5 and the second inner confining sheet 6 need to be connected in the inflatable chamber, and therefore, the manufacturing process is complex, the processing difficulty is great, and the production cost is high.

SUMMARY

Example embodiments may address at least the above problems and/or disadvantages and other disadvantages not described above. Also, example embodiments are not required to overcome the disadvantages described above, and may not overcome any of the problems described above.

According to an aspect of an example embodiment, an inflatable product comprises: a top sheet, a bottom sheet, and a lateral confining sheet comprising an upper edge connected to a peripheral edge of the top sheet and a lower edge connected to a peripheral edge of the bottom sheet, such that an inflatable chamber is defined between the top sheet and the bottom sheet; an internal connecting sheet disposed in the inflatable chamber, the internal connecting sheet comprising: an upper edge connected to the top sheet, a lower edge connected to the bottom sheet, and a connecting part, located between the upper edge and the lower edge of the internal connecting sheet; and at least one welding seam connecting the connecting part of the internal connecting sheet to the lateral confining sheet.

The upper edge of the internal connecting sheet may be connected to a portion of the top sheet inside the peripheral edge of the top sheet, and the lower edge of the internal connecting sheet may be connected to a portion of the bottom sheet inside the peripheral edge of the bottom sheet.

The internal connecting sheet may be a closed annular sheet.

The internal connecting sheet may comprise a plurality of mutually independent internal connecting sheet sections.

The inflatable product may further comprise a plurality of notches are formed in the internal connecting sheet.

The internal connecting sheet may comprise a plurality of corner portions, and a notch located at each of the plurality of corner portions.

The at least one welding seam may have a shape of one of a wavy line, a "Z" shape, a "W" shape, lattice circles, intersecting circles, intersecting arcs, and a rhomboid.

The inflatable product may further comprise a tensioning member disposed in the inflatable chamber and connecting the top sheet to the bottom sheet, wherein the tensioning member comprises one of a Y-shaped tensioning member, an X-shaped tensioning member, a straight tensioning member, a columnar tensioning member, and a tensioning member with circular apertures therein.

According to an aspect of another example embodiment, an inflatable product comprises: a top sheet, a bottom sheet, and a lateral confining sheet having an annular shape and comprising an upper edge connected to a peripheral edge of the top sheet and a lower edge connected to a peripheral edge of the bottom sheet, such that an inflatable chamber is defined between the top sheet and the bottom sheet and bounded by the lateral confining sheet; at least one internal connecting sheet comprising: an upper edge connected to the top sheet along an upper welding seam substantially parallel to the peripheral edge of the top sheet, a lower edge connected to the bottom sheet along a lower welding seam substantially parallel to the peripheral edge of the bottom sheet, and a connecting part connected to the lateral confining sheet along at least one lateral welding seam.

BRIEF DESCRIPTION OF THE DRAWINGS

The above and/or other aspects will become apparent and more readily appreciated from the following description of example embodiments, taken in conjunction with the accompanying drawings, in which.

DETAILED DESCRIPTION

Figure 1:
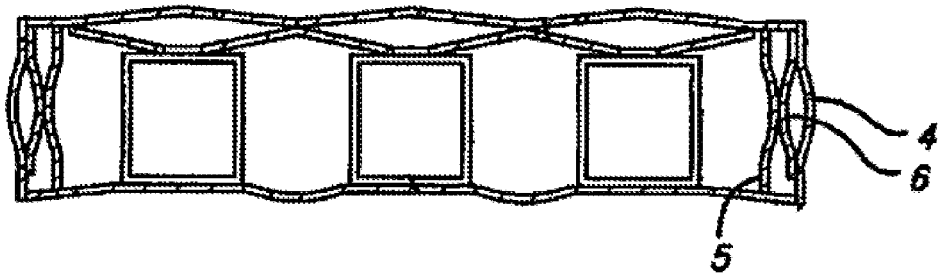
FIG. 1 is a side section of an inflatable product according to related art.

Reference will now be made in detail to example embodiments which are illustrated in the accompanying drawings, wherein like reference numerals refer to like elements throughout. In this regard, the example embodiments may have different forms and may not be construed as being limited to the descriptions set forth herein.

It will be understood that the terms "include," "including", "comprise, and/or "comprising," when used in this specification, specify the presence of stated features, integers, steps, operations, elements, and/or components, but do not preclude the presence or addition of one or more other features, integers, steps, operations, elements, components, and/or groups thereof.

It will be further understood that, although the terms "first," "second," "third," etc., may be used herein to describe various elements, components, regions, layers and/or sections, these elements, components, regions, layers and/or sections may not be limited by these terms. These terms are only used to distinguish one element, component, region, layer or section from another element, component, region, layer or section.

As used herein, the term "and/or" includes any and all combinations of one or more of the associated listed items. Expressions such as "at least one of," when preceding a list of elements, modify the entire list of elements and do not modify the individual elements of the list.

Various terms are used to refer to particular system components. Different companies may refer to a component by different names—this document does not intend to distinguish between components that differ in name but not function.

Matters of these example embodiments that are obvious to those of ordinary skill in the technical field to which these example embodiments pertain may not be described here in detail.

As would be understood by one of skill in the art, any of the various example features and aspects of example embodiments shown and described with reference to any of the accompanying drawings may be combined with the features and/or aspects of any other of the example embodiments.

Figure 2:
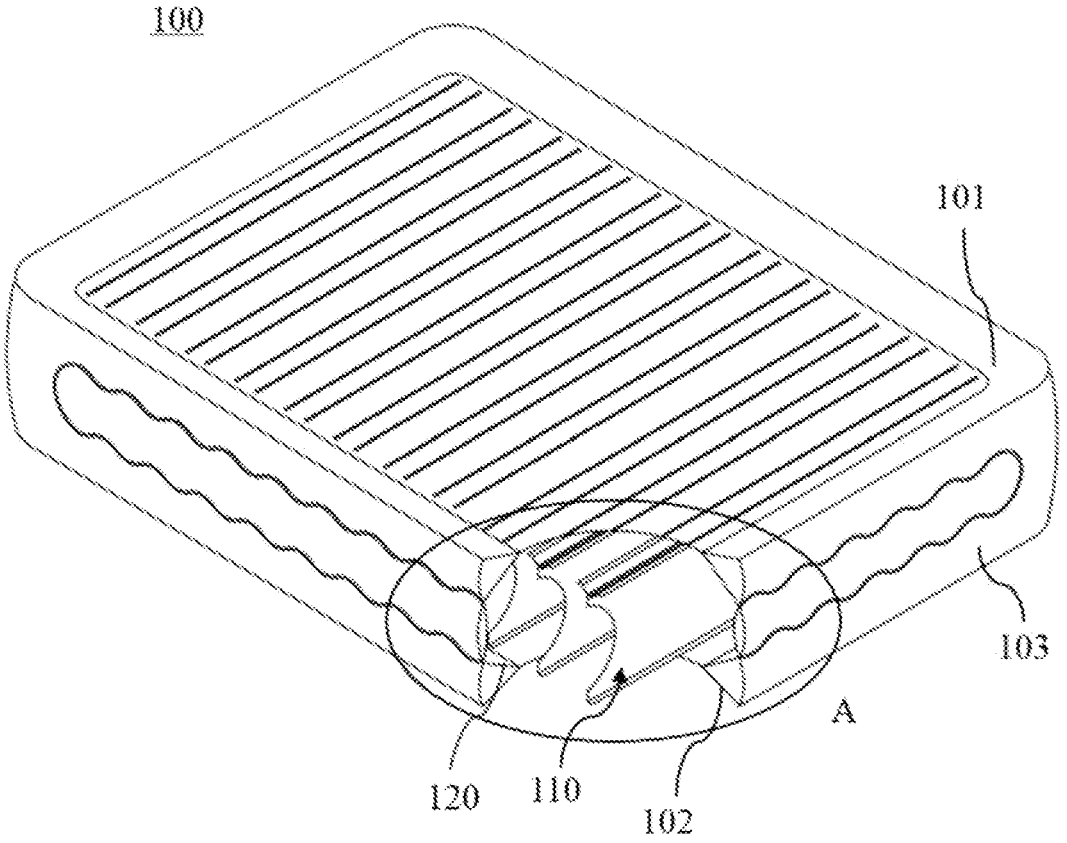
FIG. 2 is a schematic diagram of an inflatable product according to an example embodiment.
Figure 3:
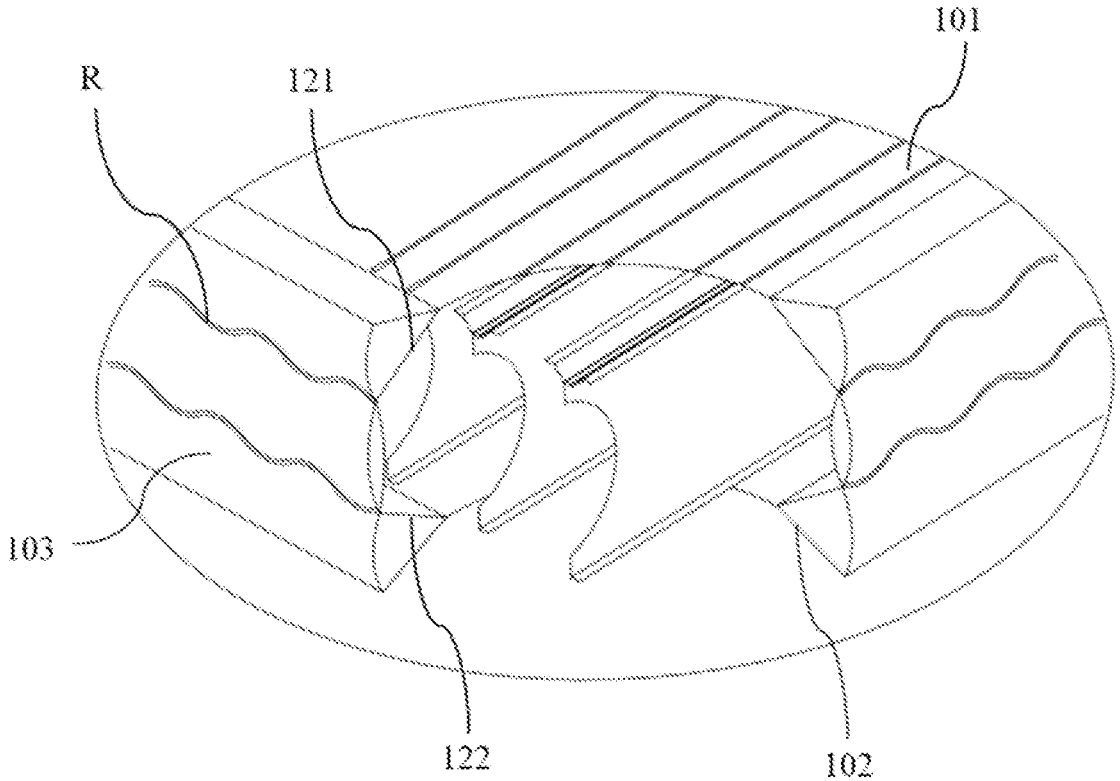
FIG. 3 is an enlarged schematic diagram of part A of FIG. 2.
Figure 4:
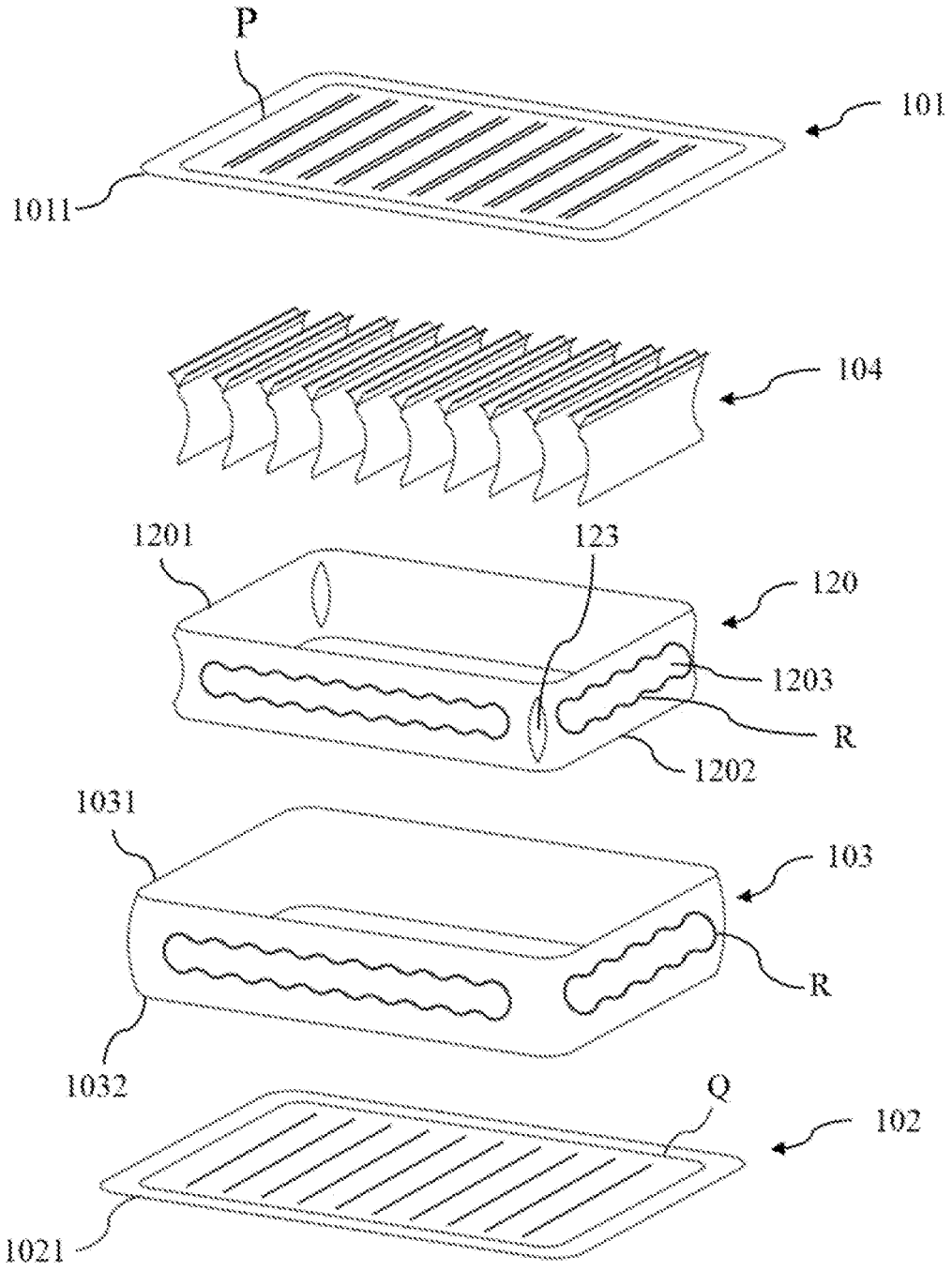
FIG. 4 is an exploded schematic diagram of the inflatable product as shown in FIG. 2.

FIG. 2 to FIG. 4 illustrate an inflatable bed 100, according to an example embodiment. The inflatable bed 100 is provided with side embossment. As shown in the exploded schematic diagram of FIG. 4, the inflatable bed 100 may include at least a top sheet 101, a bottom sheet 102, and a lateral confining sheet 103, where an edge 1011 of the top sheet 101 (e.g. an outer circumferential edge) is connected to an upper edge 1031 of the lateral confining sheet 103, and an edge 1021 of the bottom sheet 102 (e.g. an outer circumferential edge) is connected to a lower edge 1032 of the lateral confining sheet 103, forming an inflatable chamber 110 therewithin. The lateral confining sheet may have a closed annular shape which may have a substantially circular cross-section, or may be a substantially square annulus, a substantially rectangular annulus, or may have another annular shape, as would be understood by one of skill in the art The inflatable bed 100 further includes an internal connecting sheet 120 located in the inflatable chamber 110. The internal connecting sheet 120 is has an upper edge 1201 connected to the top sheet 101, a lower edge 1202 connected to the bottom sheet 102, and a connecting part 1203 located between the upper edge 1201 and the lower edge 1202. The connecting part 1203 is connected to the lateral confining sheet 103 via at least one welding seam R, and the at least one welding seam R may form one or more side embossments of the inflatable bed 100.

Specifically, the upper edge 1201 of the internal connecting sheet 120 is connected to the top sheet 101 inside the edge 1011 of the top sheet 101. For example, the upper edge 1201 of the internal connecting sheet 120 may be connected to the top sheet 101 by a welding seam P. The lower edge 1202 of the internal connecting sheet 120 is connected to the bottom sheet 102 inside the edge 1021 of the top sheet 101. For example, the lower edge 1202 of the internal connecting sheet 120 may be connected to the bottom sheet 102 by a welding seam Q.

As shown in FIG. 3, the internal connecting sheet 120 may be connected to the lateral confining sheet 103 by one or more welding seams R. An area of the internal confining sheet above the welding seam(s) R is a first portion 121, which includes the upper edge 1201 of the internal confining sheet which is connected to the top sheet 101. An area of the internal confining sheet below the welding seam(s) R is a second portion 122, which includes the lower edge 1202 of the internal confining sheet which is connected to the bottom sheet 102. The first portion 121 is an upper oblique tensioning sheet connecting the top sheet 101 to the lateral confining sheet 103 in the inflatable chamber 110, and the second portion 122 is a lower oblique tensioning sheet connecting the bottom sheet 102 to the lateral confining sheet 103. The upper oblique tensioning sheet and the lower oblique tensioning sheet each serve as an internal tensioning member for shaping the inflatable chamber 110.

As shown in FIG. 4, the internal connecting sheet 120 may be a closed annular sheet. The closed annular sheet may have a substantially circular cross-section, or may be a substantially square annulus, a substantially rectangular annulus, or may have another annular shape, as would be understood by one of skill in the art. According to an example aspect, the first portion 121 and the second portion 122 of the internal connecting sheet 120 may have different heights; in other words, a distance between the one or more welding seam(s) and the upper edge 1201 may be different than a distance between the one or more welding seam(s) and the lower edge 1202. Likewise, according to an example aspect, a length of the first portion 121 and a length of the second portion 122 may differ; in other words, there may be an upper welding seam R, defining a lower edge of the first portion 121 and a second welding seam R defining an upper edge of the second portion, and the lengths of the upper welding seam R and the lower welding seam R may differ. According to another example aspect, the heights of the first portion 121 and the second portion 122 may each vary; in other words, the one or more welding seams R defining the lower edge of the first portion 121 and the upper edge of the second portion 122 may be wavy (as shown in FIG. 4) or zig-zag, or may otherwise define varying distances from the upper edge 1201 and the lower edge 1202 along the length of the welding seam(s). Further optionally, the inclination angle of the upper oblique tensioning sheet relative to the top sheet 101 can be the same as or different from the inclination angle of the lower oblique tensioning sheet relative to the bottom sheet 102.

With further reference to FIG. 2 to FIG. 4, the welding seam R transversely extends through at least a distance of greater than half a transverse length of the internal connecting sheet 120. That is, along a circumference of the lateral confining sheet 103, the internal connecting sheet 120 is connected to the lateral confining sheet 103 along a distance of greater than half of the length or along an entire length of the internal connecting sheet 120. Accordingly, the internal connecting sheet 120 is connected to the lateral confining sheet 103, and may form both the side embossment and the internal tensioning member.

According to one or more example embodiments, the internal connecting sheet 120 which is a closed annular sheet is not only compatible for use in a rectangular or square inflatable bed, but also compatible for use in a circular or otherwise rounded inflatable bed. For an inflatable bed with corners, for example, a rectangular inflatable bed or a square inflatable bed, as shown in FIG. 4, notches 123 may be formed in the internal connecting sheet 120 which is configured to be a closed annular sheet, such that the internal connecting sheet 120 and the lateral confining sheet 103 fit better in a welding process, thereby providing a better aesthetic, and also reducing a weight of the inflatable product. For an inflatable bed with corners, the internal connecting sheet 120 may be correspondingly provided with corner portions, and the notches 123 may be located at the corner portions of the internal connecting sheet 120. For example, the notches 123 may be formed in two corner portions in a diagonal relationship, or the notches 123 may be formed in all corner portions of the internal connecting sheet 120. It should be noted that for the internal connecting sheet 120 which is configured to be a closed annular sheet, the notches 123 may be formed without splitting the internal connecting sheet 120. For a circular inflatable bed, the notches may be formed in the internal connecting sheet 120 at intervals, or the internal connecting sheet 120 may be an annular sheet without notches.

For a closed annular internal connecting sheet 120, the internal connecting sheet of the inflatable product may be selectively welded with the lateral confining sheet, and the welding may form embossment on part of a side surface of the inflatable product. According to an example aspect, the welding of the internal connecting sheet with the lateral confining sheet may be only in a substantially horizontal direction of the inflatable bed, and not in a substantially vertical direction thereof. Alternately, the welding may be in any direction.

Figure 5:
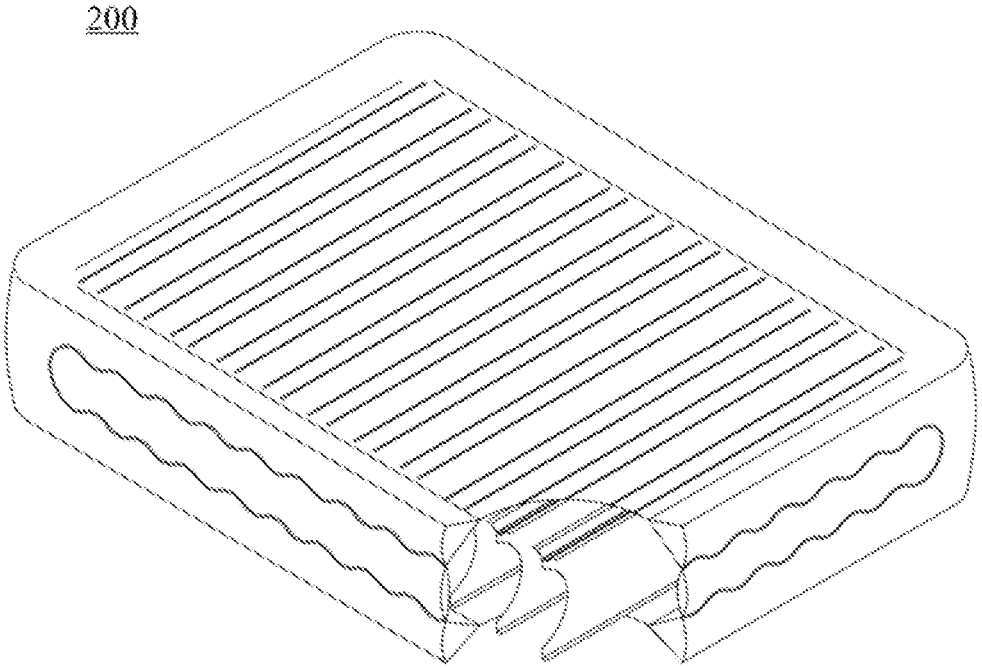
FIG. 5 is a schematic diagram of an inflatable product according to another example embodiment.
Figure 6:
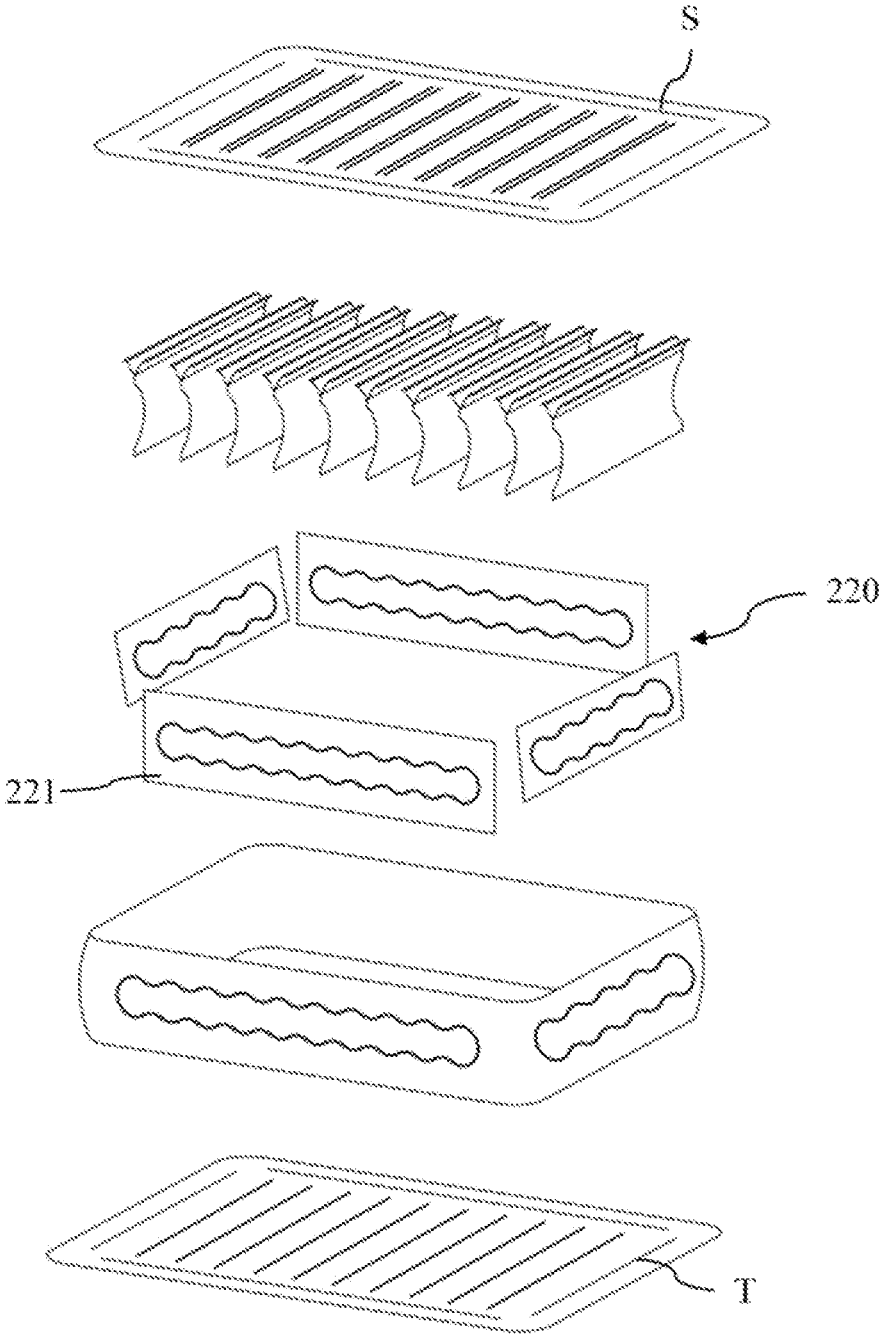
FIG. 6 is an exploded schematic diagram of the inflatable product as shown in FIG. 5.

An inflatable bed 200 according to another example embodiment is shown in FIG. 5 and FIG. 6, and a difference between the inflatable bed 200 and the inflatable bed 100 shown in FIG. 2 to FIG. 4 may be the structures of the internal connecting sheets 220. According to this example embodiment, multiple mutually independent internal connecting sheets 220 are provided. Accordingly, in this example embodiment, the welding seams between the internal connecting sheets 220 and the top sheet are discontinuous welding seams S, and welding seams between the internal connecting sheets 220 and the bottom sheet are discontinuous welding seams T.

Taking a rectangular inflatable bed as an example, a lateral confining sheet of the inflatable bed forms a plurality of side surfaces of the inflatable product, and four side surfaces are shown in FIG. 6. In this example embodiment, the multiple internal connecting sheets 220, which are each independent of each other, may comprise a plurality of disconnected sheets in a number corresponding to a number of the side surfaces of the inflatable bed. Accordingly, in the example embodiment shown in FIGS. 5, and 6, there are four internal connecting sheets 220, comprising four disconnected sheets 221. The dimensions of each of the four disconnected sheets 221 may be the same as the dimensions of the respectively corresponding side surfaces or may be different. As desired, according to another example aspect, a number of the disconnected sheets 221 may be less than the number of the side surfaces of the inflatable product. The disconnected sheets 221 and the lateral confining sheet may be connected by welding seams of same or different structures. In other words, the disconnected sheets 221 can be welded with the lateral confining sheet to form side embossments of the same and/or different shape structures.

As shown in FIG. 2 and FIG. 4, the structures of the welding seams R, connecting the internal connecting sheets and the lateral confining sheet, may be closed wavy lines, such that a closed wavy side embossment is formed. However, it should be noted that the shape(s) of the welding seams are not limited to this implementation. The welding seams can be arranged transversely, longitudinally or obliquely with respect to the inflatable product, and may be in the shape of, but not limited to, a wavy line, a "Z", a "W", lattice circles, intersecting circles, intersecting arcs or a rhomboid. The welding seams may be closed or discontinuous. For example, the welding seams as shown in FIG. 2 to FIG. 4 are closed wavy structures, and a lattice-circle structure is one of a number of various discontinuous shape structures.

As shown in FIG. 3 and FIG. 4, an inflatable bed 100, according to one or more example embodiments, may further include a tensioning member 104 which is located in the inflatable chamber 110 and connects the top sheet 101 to the bottom sheet 102. The tensioning member 104 may comprise one or more Y-shaped tensioning member(s) (as shown in FIG. 4 and FIG. 6), one or more X-shaped tensioning member(s), one or more straight tensioning member(s), one or more a tensioning member(s) with circular apertures, one or more tensioning member(s) with a columnar tensioning member, or one or more tensioning member(s) having any of various other shapes, as would be understood by one of skill in the art. As shown in FIG. 2, the tensioning member 104 comprises a plurality of tensioning members, each connected to the top sheet 101 and to the bottom sheet 102 of the inflatable bed 100, forming embossments on the top sheet 101 and bottom sheet 102. For example, the embossments may comprise a plurality of parallel lines on the top sheet 101 and the bottom sheet 102.

As compared with side embossments of related art, an inflatable product according to one or more example embodiments described herein have a simple structure, excellent aesthetics, and good support, and a process of making embossments according to one or more example embodiments may be optimized.

According to one or more example embodiments, an inflatable product may be any one of an inflatable bed, as shown in the figures, an inflatable cushion, an inflatable sofa, an inflatable toy (for example, an inflatable castle), an inflatable pool, and any of various other inflatable products, as would be understood by one of skill in the art. FIG. 2 to FIG. 6 illustrate internal connecting sheets 120/220 of a same height. According to one or more of the example embodiments, internal connecting sheets forming the side embossment may have variable heights. For example, for an inflatable bed with a backrest, an internal connecting sheet corresponding to the backrest of the inflatable bed may have a height greater than that of other internal connecting sheets so as to be connected with a lateral confining sheet of the backrest to form a side embossment on the backrest.

It may be understood that the example embodiments described herein may be considered in a descriptive sense only and not for purposes of limitation. Descriptions of features or aspects within each example embodiment may be considered as available for other similar features or aspects in other example embodiments.

While example embodiments have been described with reference to the figures, it will be understood by those of ordinary skill in the art that various changes in form and details may be made therein without departing from the spirit and scope as defined by the following claims.

What is claimed is:

1. An inflatable product comprising:

a top sheet, a bottom sheet, and a confining sheet having an annular shape and comprising an upper edge connected to a peripheral edge of the top sheet and a lower edge connected to a peripheral edge of the bottom sheet, such that an inflatable chamber is defined between the top sheet and the bottom sheet and bounded by the confining sheet;

at least one connecting sheet comprising:

an upper edge welded to the top sheet along an upper welding seam parallel to the peripheral edge of the top sheet, a lower edge welded to the bottom sheet along a lower welding seam parallel to the peripheral edge of the bottom sheet, and a connecting part welded to the confining sheet along at least one lateral welding seam between the upper welding seam of the upper edge and the lower welding seam of the lower edge.

2. The inflatable product according to claim 1, wherein the at least one connecting sheet comprises:

a first connecting sheet, a second connecting sheet, a third connecting sheet, and a fourth connecting sheet, respectively connected to the top sheet along upper welding seams substantially parallel to a first side, a second side, a third side, and a fourth side of the top sheet, and respectively connected to the bottom sheet along lower welding seams substantially parallel to a first side, a second side, a third side, and a fourth side of the bottom sheet.

3. The inflatable product according to claim 1, wherein the at least one connecting sheet comprises an annular connecting sheet.

4. The inflatable product according to claim 3, wherein the inflatable product is substantially polygonal, and wherein the connecting sheet comprises a notch formed therein at a location corresponding to each of a plurality of corners of the inflatable product.

5. The inflatable product according to claim 1, wherein the lateral welding seam is substantially parallel to each of the upper welding seam and the lower welding seam.

6. The inflatable product according to claim 1, wherein the lateral welding seam comprises a closed shape.

7. The inflatable product according to claim 1, wherein the lateral welding seam comprises one of a wavy line, a zig-zag line, or a substantially straight line.

8. The inflatable product according to claim 1, further comprising:

at least one tensioning member disposed in the inflatable chamber and comprising at least one upper edge connected to the top sheet and at least one lower edge connected to the bottom sheet.

* * * * *